United States Patent [19]

Mikulecky et al.

[11] Patent Number: 4,591,816

[45] Date of Patent: May 27, 1986

[54] LOW OIL TRIP AND/OR LOCKOUT APPARATUS

[75] Inventors: Harvey W. Mikulecky, Oconomowoc; Todd K. Knapp, Waukesha, both of Wis.

[73] Assignee: RTE Corporation, Waukesha, Wis.

[21] Appl. No.: 699,423

[22] Filed: Feb. 7, 1985

[51] Int. Cl.[4] ..... H01H 75/12; H01H 77/00; H01H 9/20

[52] U.S. Cl. ..... 335/6; 335/37; 335/164

[58] Field of Search ..... 335/1, 6, 29, 37, 164, 335/168; 361/37

[56] References Cited

U.S. PATENT DOCUMENTS 4,435,690 3/1984 Link ..... 335/37

*Primary Examiner*—Harold Broome

*Attorney, Agent, or Firm*—Ronald E. Barry

[57] ABSTRACT

A low oil lock-out and/or trip apparatus for a submersible transformer circuit breaker of the type having a manually operated crank shaft assembly for opening and closing the circuit breaker and a fault trip assembly for opening the circuit breaker under fault current conditions, the apparatus including a float assembly which is responsive to changes in oil level in said transformer and a rod carried by said float for blocking the movement of the crankshaft and a trip member for tripping the trip assembly when the oil level drops below a predetermined level in the transformer.

16 Claims, 8 Drawing Figures

LOW OIL TRIP AND/OR LOCKOUT APPARATUS

BACKGROUND OF THE INVENTION

In my earlier U.S. Pat. No. 4,435,690, entitled "Primary Circuit Breaker" and issued on Mar. 6, 1984, and in my co-pending application, Ser. No. 06/572,913, filed on Jan. 23, 1984, and entitled "Trip Assembly For A Circuit Breaker" an under oil primary circuit breaker was disclosed for interrupting fault currents in the primary circuit of a transformer. These circuit breakers included an arc chamber which is immersed in the oil and is used to extinguish the arc produced between the interrupter contacts on current interrution. The primary circuit breaker is used to interrupt current under fault current conditions as well as to manually deenergize the transformer. If the oil in the transformer has dropped below the level of the arc chamber, the arc produced on interruption will be in an air medium and may not extinguish until major damage has been done to the transformer.

SUMMARY OF THE INVENTION

The low oil trip and/or lockout apparatus according to the present invention is designed to respond to the level of oil in the transformer and to either trip the circuit breaker to open the circuit and/or to lockout the manual system so that the operator cannot open the circuit if the oil level has dropped below the upper level of the arc chamber. This has been accomplished by providing a float on the breaker assembly which is responsive to the level of oil in the transformer. A lockout rod is attached to the float and moves with the float to block the movement of the manual actuating system. A mechanical or magnetic release mechanism can also be provided on the float to trip the circuit breaker when the oil level drops to the top of the arc chamber.

IN THE DRAWINGS

Figure 6:
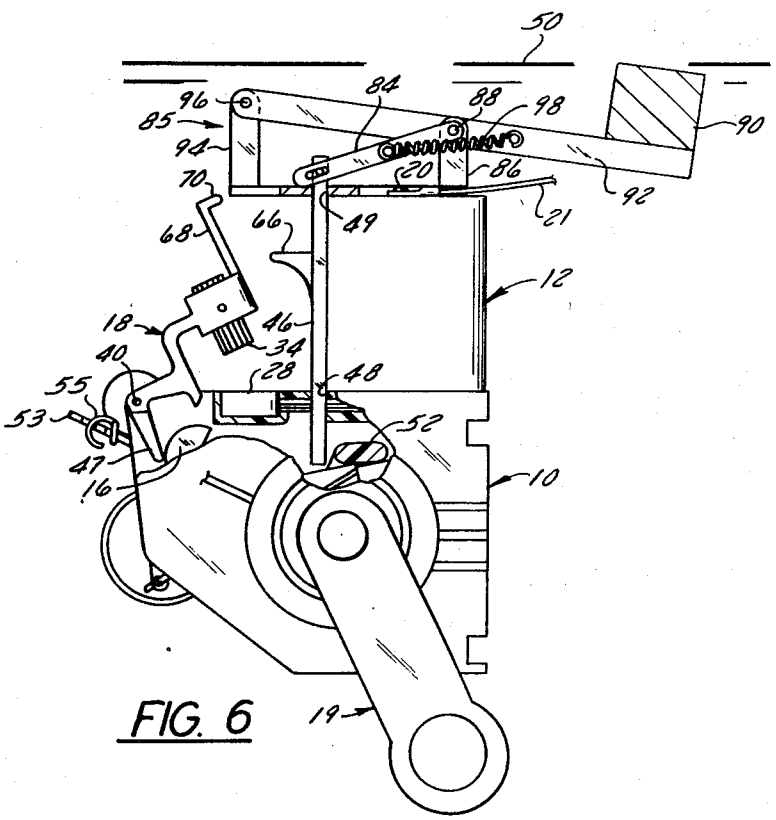
Figure 5:
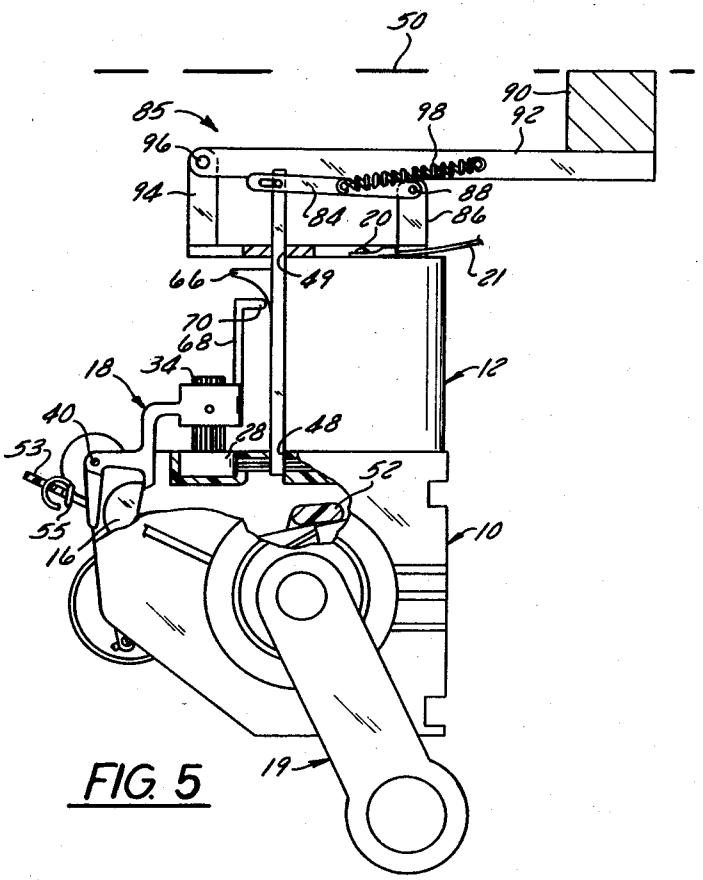
FIG. 5 is a view of the lockout apparatus having an over center toggle trip and release mechanism.

FIG. 6. is a view similar to FIG. 5 showing the trip and release mechanism in the lockout position.

Figure 7:
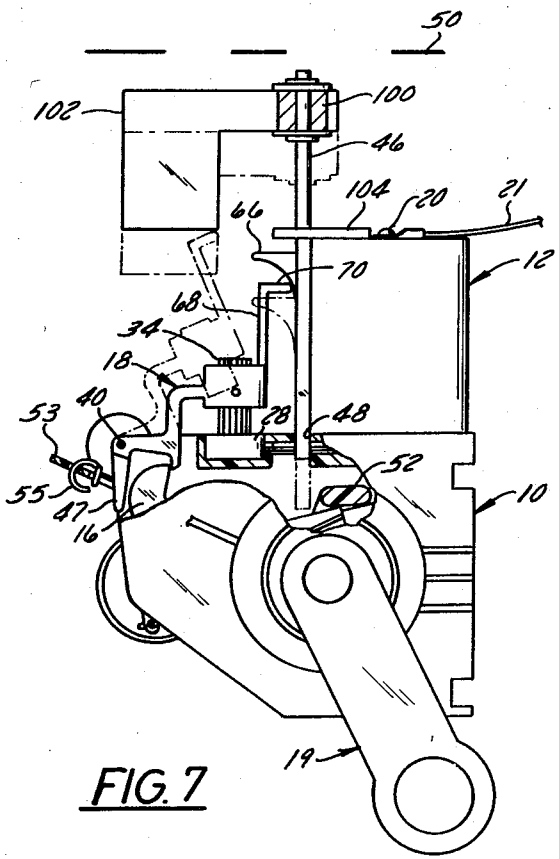

FIG. 7 is a view of an alternate mechanical lockout apparatus.

Figure 8:
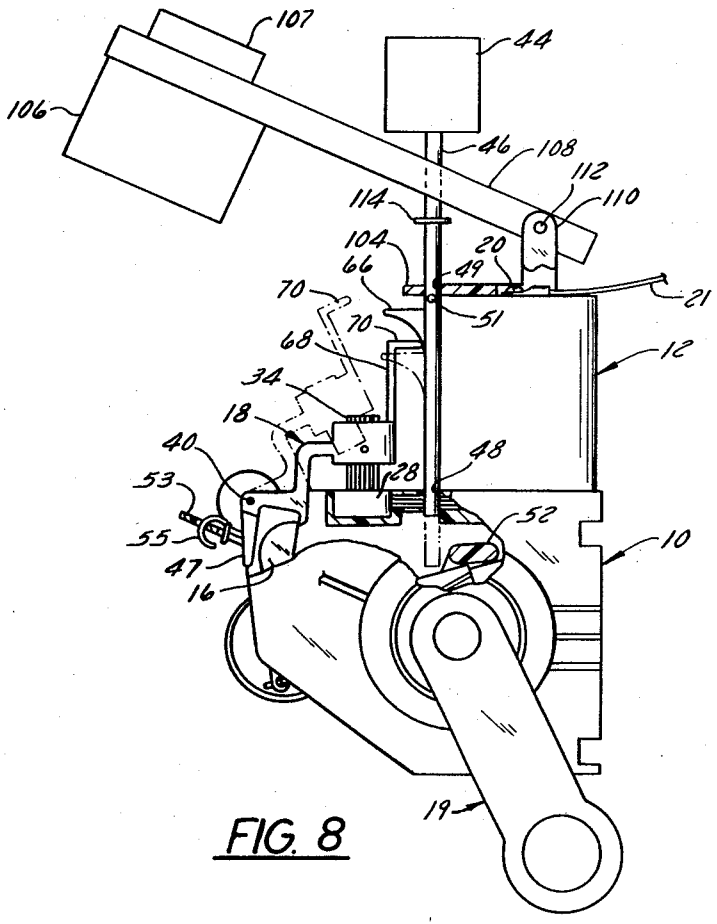

FIG. 8 is a view of another embodiment of the invention showing a double float trip mechanism.

DESCRIPTION OF THE INVENTION

Primary circuit breakers of the type contemplated herein and as disclosed in my earlier patent and co-pending application, generally include a base 10 having mounted thereon an arc extinguishing assembly 12, a latch mechanism 14, a trip lever 16, a trip assembly 18 and a manua11y actuated crank shaft assembly 19. A fixed contact 20 is provided in the work chamber 24 of the arc extinguishing assembly and is connected to the primary bushing of the transformer by a line 21. A movable rod contact 22 is positioned in the work chamber 24 and is operatively connected to the latch mechanism 14. Under fault current conditions, the rod 22 is moved away from the contact 20, producing an arc which builds up pressure in the work chamber 24. The arc is extinguished by the cross-blast of the gases built up in chamber 24 across the arc produced between the contact 20 and rod 22. These gases are discharged through the passage 26.

The latch mechanism 14 is moved between open and closed positions by means of the manual crankshaft assembly 19 which includes an eccentric crank section 52 and a yoke 53. The yoke is connected to the latch mechanism 14 by means of a spring 55. The yoke 53 is rotated past the pivot point 57 of the latch mechanism 14 to move the rod 22 into and out of engagement with the contact 20. The latch mechanism 14 includes a first lever 15 connected to spring 55 and a second lever 17 connected to the contact 20.

The trip lever 16 is tripped by the magnetic trip assembly 18 to release the rod 22 from the latch mechanism 14 to open the circuit under a fault condition. The fault condition is sensed by a heating element 28 provided in the trip assembly 18. The element 28 is connected to the power source by a line 30 and to the rod 22 by a line 32. The trip assembly includes a magnet 34 supported on a bell crank 36 which is biased by a spring 38 to pivot about the pivot point 40. The bell crank 36 includes an arm 47 which is positioned to engage the trip lever 16. The trip lever 16 is connected to a latch member 59 that is mounted on the first lever 15. The latch member 59 connects the first lever 15 to the second lever 17. The second lever 17 is released from the first lever 15 when the trip lever 16 is pivoted by the bell crank 36. The magnet 34 in the trip assembly 18 is released when the heating element 28 reaches the Curie temperature.

Figure 1:
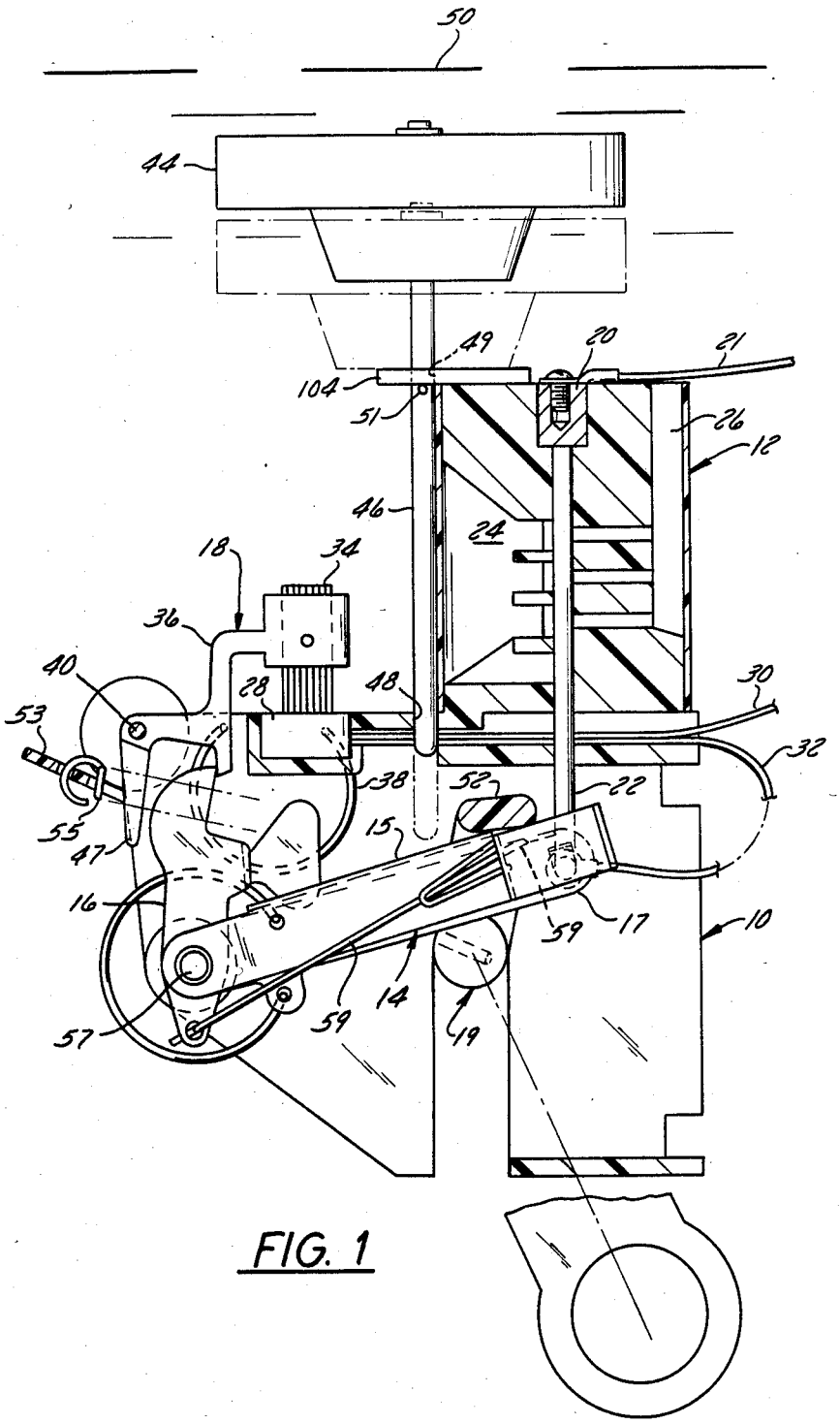
FIG. 1 is a side elevation view in section of a primary circuit interrupter showing the lockout apparatus mounted on the arc chamber.

In the embodiment of the invention shown in FIG. 1, the circuit breaker is shown in the closed position. The lockout apparatus or device includes a float 44 mounted on an insulating rod 46 which is supported in a pair of openings 48, 49 provided in the base 10 and guide plate 104, respectively. The float responds to the level of the oil 50 in the transformer. In FIG. 1 the float is shown in the elevated position and in phantom lines in the lockout position. In the solid line position, the rod 46 is located just above the crank shaft section 52 and is prevented from further upward movement by means of a pin 51 which engages guide plate 104. In the phantom line position, the rod 46 is located in the path of motion of the crank shaft section 52, preventing manual opening of the contacts.

Figure 2:
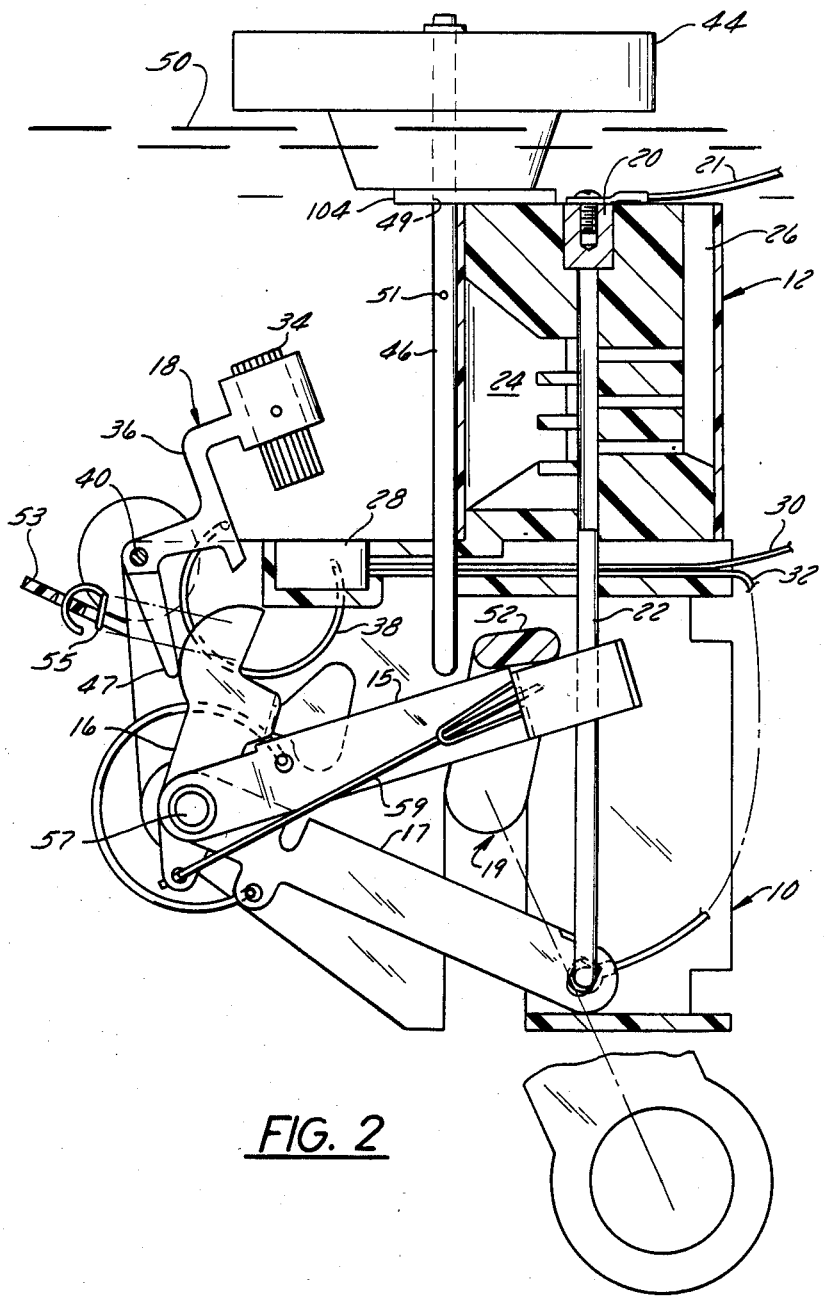
FIG. 2 is a view similar to FIG. 1 showing the lockout apparatus in the lockout position.

In FIG. 2, the circuit breaker is shown in the open position. The oil level 50 is shown at a predetermined level with respect to the arc interrupting assembly with the float 44 shown resting on the guide plate 104 on the upper surface of the arc extinguishing assembly 12. The rod 46 has moved downward into the path of motion of the crank section 52. The rod 46 will prevent rotation of the crank section 52.

Figure 3:
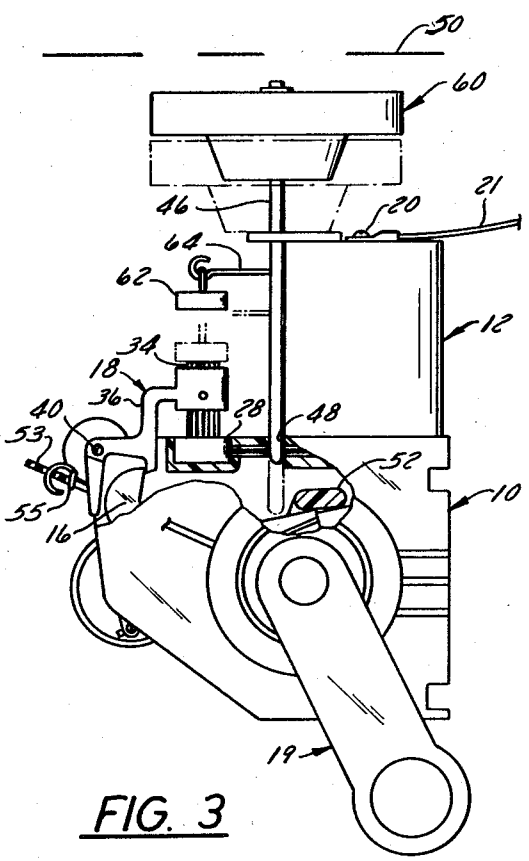
FIG. 3 is a view of a lockout apparatus including a magnetic release mechanism.

In FIG. 3 a magnetic trip and lockout apparatus or device 60 is shown which is used to both trip the trip assembly 18 as well as lockout any movement of the crank arm 52. In this regard, a soft iron member 62 is mounted on the rod 46 by means of an arm 64. As the iron member is moved toward the magnet 34, substantially all of the magnetic flux of the magnet will shunt through the soft iron member 62. This will greatly reduce the attraction of the magnet to the heating element 28. As the iron member 62 approaches the magnet 34, the attraction of the magnet to the soft iron member will increase pulling the float 60 downward in the oil. The pull up force of the float acting on the magnet will increase due to the buoyancy effect of the float in the oil. Eventually, the increasing forces acting on the magnet will produce a sudden release of the magnet 34 from the element 28. This will trip the trip lever 16 to release the latch mechanism 14 from the rod contact 22 to open the circuit. Higher forces can be achieved for opening the trip assembly by replacing the soft iron 62 with a matching magnet to pull against the magnet 34.

As soon as a transformer becomes de-energized, customers call the power company to complain of a loss of service. The lineman troubleshooter would then be sent out to replace the faulted transformer. If he were to attempt to reclose the transformer, the latch mechanism would not hold the rod 22 because the soft iron member 62 would still be on the magnet. Thus, the rod 22 would trip out immediately. As long as there was no gross leak of oil, the oil level would still remain high enough in the interrupter chamber to allow satisfactory switching. However, if the oil level had dropped, then the latch mechanism would have been tripped to release the rod 22 to the open position and the end of the insulating rod 46 would have dropped far enough to prevent the lineman from reclosing the interrupter.

Figure 4:
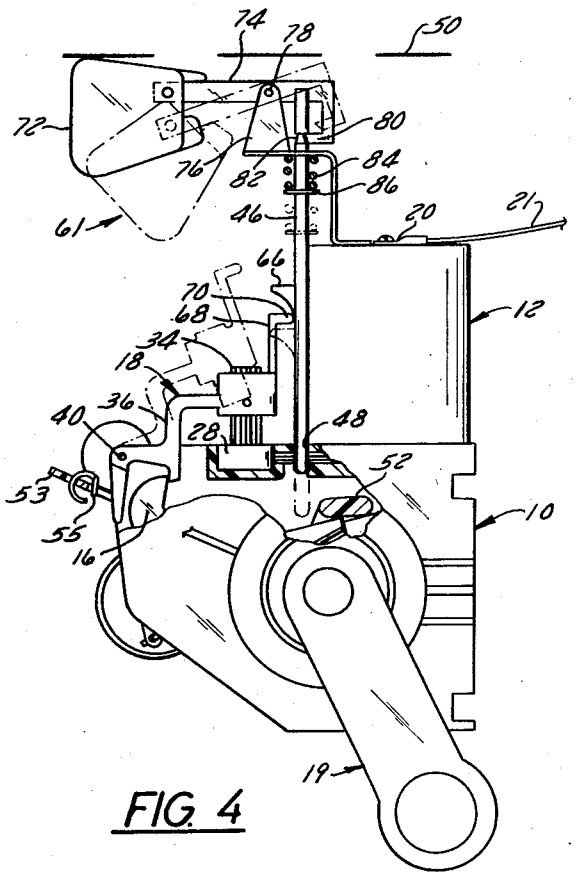
FIG. 4 is a view of a lockout apparatus having a mechanical release mechanism.

In FIG. 4, another embodiment is shown which utilizes a mechanical trip member 61 to open the circuit. In this embodiment, a cam or ramp 66 is mounted on the rod 46 and a release arm 68 having a cam follower 70 is provided on the magnet 34. When the float moves down, the cam follower 70 will ride up on the cam or ramp 66, pushing the magnet 34 away from the element 28 far enough for the magnet to be released from the element and to trip the trip release 16 to open the contacts in the arc extinguishing assembly.

The rod 46 is controlled by means of a float 72 mounted on an arm 74 that is pivotally supported on a bracket 76 by means of a pin 78. The rod is held in an upward position by means of a tab 80 mounted on the end of the arm 74 which is movable into a latching position in a groove 82 provided in the rod 46.

Means are also provided for biasing the rod 46 to the lockout position. Such means is in the form of a spring 84 mounted on the rod 46 between the bracket 76 and a retainer ring 86 mounted on the rod. When the float drops downward far enough to release the tab 80 from the groove 82, the spring will snap the rod 46 downward mechanically pushing the magnet 34 away from the element 28 far enough to trip the trip lever to interrupt the circuit and lockout rod 46 will drop to the locking position in front of the crank section 52.

In FIGS. 5 and 6, another form of mechanical release trip lockout apparatus 85 is shown. The rod 46 is connected to an arm 84 pivotally mounted on a bracket 86 by means of a pin 88. A float 90 is mounted on the end of an arm 92 which is pivotally mounted on a bracket 94 by means of a pin 96. The arm 92 is connected to the arm 84 by means of spring 98. As the float 90 moves downward to the position shown in FIG. 6, the spring 98 will be moved over center far enough to snap the arm 84 downward to push the rod down. The cam 66 will push the cam follower 70 far enough to trip the trip assembly 18 to interrupt the circuit and rod 46 will lockout the path of motion of the crankshaft section 52.

In FIG. 7, the trip lockout mechanism includes a weight 100 mounted on the upper end of the rod 46 with a float 102 connected to the weight 100. When the oil level drops, the net difference between the weight and the buoyancy will produce a downward force on the rod 46. Movement will be impeded until sufficient force is built up to overcome the magnetic force between the magnet 34 and the element 28. When the force is overcome, the trip assembly will open the interrupter and the weight will cause the rod 46 to drop down to the lockout position. In this embodiment, the rod 46 should be made square where it passes through the guide plate 104 so that the float 102 will not interfere with the release arm 68 on the magnet 34.

In FIG. 8, a double float trip lock automatic mechanism is shown which provides a positive force for tripping the magnet 34 away from element 28. The first float 44 is mounted on a rod 46 as shown in FIG. 1. The second float 106 is mounted on a lever arm 108 that is pivotally mounted on a support 110 by means of a pin 112. A weight 107 may be added to the end of arm 108, if desired. The operation of the interrupter is the same as described for the circuit breaker of FIG. 1. The first float 44 of the lockout mechanism shown in FIG. 8 will float with the oil level to move the rod 46 into the path of motion of the crank 52. The second float 106 will also follow the oil level pivoting the arm downward into engagement with a stop member 114 provided on the rod 46. The increasing weight of the float 106 and weight 107, if added, will snap the latch open if the first float 44 is not heavy enough to open the latch.

The embodiments of the invention in which an exclusive property or privilege is claimed, are defined as follows:

1. A low oil responsive lockout apparatus for an under oil primary circuit breaker of the type including an arc extinguishing assembly having an arc chamber with a fixed contact at one end of the chamber and a rod contact movable into engagement with the fixed contact within the arc chamber, a latch mechanism operably connected to move said rod contact between open and closed positions with respect to said fixed contact, a fault current trip assembly for releasing said latch mechanism from said rod contact so that said rod contact will move away from said fixed contact and a crank shaft assembly for manually moving said latch mechanism between open and closed positions, said apparatus comprising a float mounted on said arc extinguishing assembly for movement in response to changes in the level of oil in a transformer and means supported by said float for locking the crank shaft assembly in a fixed position when the oil level drops below a predetermined level with respect to the arc extinguishing assembly.

2. The apparatus according to claim 1, including means mounted on said float for tripping said trip assembly when the oil reaches the predetermined level.

3. The apparatus according to claim 1 or 2, wherein said locking means comprises a rod connected to said float and positioned for movement into the path of motion of the crank shaft assembly.

4. A low oil safety device for an underoil primary circuit breaker of the type having an arc extinguishing assembly, a fixed electrical contact mounted in said assembly and a rod contact mounted for movement into engagement with said fixed electrical contact in said assembly, a latch mechanism operably connected to said rod contact, a manually operable crank assembly connected to said latch mechanism for moving said rod contact between open and closed positions and a magnetically operated trip assemby operably connected to release said latch mechanism from said rod under fault current conditions, said safety device comprising a float assembly supported on said arc extinguishing assembly for movement in response to changes in the oil level in said transformer and including lock-out means for blocking movement of a crank shaft assembly when the oil level drops to a predetermined level with respect to the arc extinguishing assembly.

5. The device according to claim 4 wherein said lock-out means comprises a rod connected to said float and positioned to move into the path of motion of said crank shaft assembly as the oil level drops to the predetermined level.

6. The device according to claims 4 or 5 including means for tripping said trip assembly as the level of oil drops to the predetermined level.

7. The device according to claim 2 wherein said tripping means includes a magnetic shunt element mounted on said float for movement toward said trip assembly whereby the magnetic force of the trip assembly is reduced sufficiently to trip the circuit breaker.

8. The device according to claim 2 wherein said tripping means includes a cam member positioned to trip said trip assembly as the float approaches the upper level of the arc chamber.

9. The device according to claim 3 including means for biasing said rod toward said locking position.

10. The device according to claim 9 wherein said biasing means comprises a compression spring and further including means responsive to the position of the float for releasing said spring force as the oil level drops to the level of the work chamber.

11. The device according to claim 10 wherein said biasing means comprises an over center toggle mechanism.

12. The device according to claim 2 including an arm mounted for pivotal movement with respect to said arc extinguishing assembly and a stop member provided on said first float in the path of motion of said arm whereby the weight of said float will be added to said arm on engagement with said stop member.

13. The device according to claim 12 including a weight mounted on said second float.

14. The device according to claim 6 wherein said tripping means includes a magnetic shunt element mounted on said float for movement toward said trip assembly whereby the magnetic force of the trip assembly is reduced sufficiently to trip the circuit breaker.

15. The device according to claim 6 wherein said tripping means includes a cam member positioned to trip said trip assembly as the float approaches the upper level of the arc chamber.

16. The device according to claim 8 including means for biasing said rod toward said locking position.

* * * * *